US012297755B2

(12) United States Patent
Andrisani et al.

(10) Patent No.: US 12,297,755 B2
(45) Date of Patent: May 13, 2025

(54) SYSTEM FOR SYNCHRONIZING SWITCHING

(71) Applicant: Eaton Intelligent Power Limited, Dublin (IE)

(72) Inventors: Nicola Andrisani, Cumiana (IT); Fabiano C. F. Contarin, Turin (IT); Austin R. Zurface, Dowing, MI (US); Emanuele Raimondi, Collegno (IT)

(73) Assignee: Eaton Intelligent Power Limited, Dublin (IE)

( * ) Notice: Subject to any disclaimer, the term of this patent is extended or adjusted under 35 U.S.C. 154(b) by 0 days.

(21) Appl. No.: 18/883,862

(22) Filed: Sep. 12, 2024

(65) Prior Publication Data

US 2025/0003357 A1 Jan. 2, 2025

Related U.S. Application Data

(63) Continuation of application No. PCT/EP2023/025164, filed on Apr. 6, 2023.

(60) Provisional application No. 63/327,849, filed on Apr. 6, 2022.

(51) Int. Cl.

| | |
|---|---|
| ***F01L 1/18*** | (2006.01) |
| ***F01L 1/24*** | (2006.01) |
| ***F01L 13/00*** | (2006.01) |

(52) U.S. Cl.

CPC ..... *F01L 1/181* (2013.01); *F01L 1/24* (2013.01); *F01L 13/0005* (2013.01); *F01L 2001/2444* (2013.01)

(58) Field of Classification Search

CPC ..... F01L 1/181; F01L 1/24; F01L 2001/2444; F01L 13/0005

USPC ..... 123/90.36, 90.39

See application file for complete search history.

(56) References Cited

U.S. PATENT DOCUMENTS

| | | | | |
|---|---|---|---|---|
| 6,450,144 | B2 | 9/2002 | Janak | |
| 9,790,824 | B2 | 10/2017 | Baltrucki | |
| 2006/0254543 | A1 | 11/2006 | Sun | |
| 2021/0310425 | A1 | 10/2021 | Baltrucki | |
| 2023/0332520 | A1 * | 10/2023 | Guo | F01L 13/065 |

OTHER PUBLICATIONS

International search report and Written Opinion received for PCT Application No. PCT/EP2023/025164, 12 pages.

* cited by examiner

*Primary Examiner* — Jorge L Leon, Jr.
(74) *Attorney, Agent, or Firm* — Baker Botts L.L.P.

(57) ABSTRACT

In one embodiment, a system for synchronizing switching comprises a first body coupled to a pressurized fluid supply and a control fluid supply, and a second body comprising a spool valve that is configured to be contained within a spool valve housing and movable between an open position and a closed position, a biasing element that is configured to bias the spool valve, and at least three fluid channels that are configured to be fluidly connected to the spool valve housing. The first body and the second body are configured for relative movement to each other. The spool valve is further configured to selectively control fluid communication among the fluid channels based on relative movement between the first body and the second body.

17 Claims, 5 Drawing Sheets

SYSTEM FOR SYNCHRONIZING SWITCHING

PRIORITY

This application claims the benefit under 35 U.S.C. § 365 (c) of International Patent Application No. PCT/EP2023/025164, filed 6 Apr. 2023, which claims the benefit of U.S. Provisional Application No. 63/327,849, filed 6 Apr. 2022, each of which is incorporated herein by reference.

TECHNICAL FIELD

This disclosure generally relates to valve actuation system, and more particularly to a system for synchronizing switching of a switching mechanism used in a valvetrain assembly.

BACKGROUND

Various switching mechanism designs have been produced in the past for the purpose of switching mode of a valvetrain of an internal combustion engine. Because such switching mechanism typically locates in the middle of kinematic chain from a rotating camshaft to one or more engine valves and is therefore subject to considerable system loading, it is critical to control timing of switching such that it can take place only when a cam is in a precise angular position. Generally, a control system is typically employed in an attempt to synchronize switching. However, such control system tends to involve complicate control logic and computer software as it must account for a multitude of engine parameters in order to determine precise timing.

Accordingly, there is a need to achieve a system for synchronizing switching that removes or at least reduces such complexity while ensuring proper synchronization of the switching mechanism.

SUMMARY OF PARTICULAR EMBODIMENTS

The disclosure presents a system for synchronizing switching that helps to simplify control of a switching mechanism by employing a spool valve that can selectively open and/or close fluid communication among different flow passages to the switching mechanism depending on position of a rocker arm. Configured as such, precise timing of the control system is no longer required. At the same time, maximum time available for the switching mechanism is allowed such that the switching mechanism can be fully deployed in place.

In one embodiment, a system for synchronizing switching is provided, which comprises a first body coupled to a pressurized fluid supply and a control fluid supply, and a second body comprising a spool valve that is configured to be contained within a spool valve housing and movable between an open position and a closed position, a biasing element that is configured to bias the spool valve, and a plurality of fluid channels that are configured to be fluidly connected to the spool valve housing. The plurality of fluid channels at least comprises a first fluid channel, a second fluid channel, and a third fluid channel. Specifically, the first body and the second body are configured for relative movement to each other between a first relative position and a second relative position. The first fluid channel is in fluid communication with a pressurized fluid supply when the first body and the second body are in the first relative position. The second fluid channel is in fluid communication with a control fluid supply when the first body and the second body are in the second relative position. Furthermore, the spool valve is further configured to selectively control fluid communication among the third fluid channel and the other fluid channels based on relative movement between the first body and the second body.

In particular embodiments, the pressurized fluid supply is an engine pump. In particular embodiments, the control fluid supply is an oil control valve configured to selectively supply control fluid on demand. In particular embodiments, the third fluid channel is configured to be fluidly coupled with a switching mechanism.

In particular embodiments, fluid flowing from the control fluid supply via the second fluid channel into the spool valve housing is able to drive the spool valve into the open position. In particular embodiments, fluid flowing from the pressurized fluid supply via the first fluid channel is allowed to flow through the spool valve housing into the third fluid channel when the spool valve is in the open position. In particular embodiments, fluid flowing from the control fluid supply via the second fluid channel is allowed to flow through the spool valve housing into the third fluid channel when the spool valve is in the open position. In particular embodiments, fluid flowing from the pressurized fluid supply via the first fluid channel into the spool valve housing is able to maintain the spool valve in the open position.

In particular embodiments, the biasing element is configured to bias the spool valve towards the closed position. In particular embodiments, the fluid communication through the spool valve housing to the third fluid channel is disabled when the spool valve is in the closed position.

In particular embodiments, the plurality of fluid channels further comprises a fourth fluid channel that is configured to drain fluid contained within the spool valve housing when the spool valve is in the closed position. In particular embodiments, fluid communication to the fourth fluid channel is prevented by the spool valve when the spool valve is in the open position. In particular embodiments, fluid flowing from the second fluid channel is prevented to enter the third fluid channel when the spool valve is in the open position.

In particular embodiments, the biasing element is a spring. In particular embodiments, relative movement between the first body and the second body is caused by rotation of a rocker arm. In particular embodiments, fluid communication between the first fluid channel and the pressurized fluid supply is enabled when the rocker arm is at base circle position, and fluid communication between the second fluid channel and the control fluid supply is enabled when the rocker arm is around maximum lift position. In particular embodiments, fluid communication from the pressurized fluid supply through the first fluid channel and the spool valve housing to the third fluid channel is enabled when the rocker arm is at base circle position.

BRIEF DESCRIPTION OF THE DRAWINGS

Embodiments in accordance with this disclosure will now be described by reference to the accompanying drawings, in which:

FIG. 2 shows a series of schematic depictions of the system for synchronizing switching of FIG. 1 during operation when an oil control valve is turned from off to on;

DESCRIPTION OF EXAMPLE EMBODIMENTS

Reference will now be made in detail to the examples which are illustrated in the accompanying drawings. Wherever possible, the same reference numbers will be used throughout the drawings to refer to the same or like parts. Directional references such as "up", "down", "right", and "left" are for ease of reference to the figures and not intended to limit the scope of this disclosure.

Figure 1:
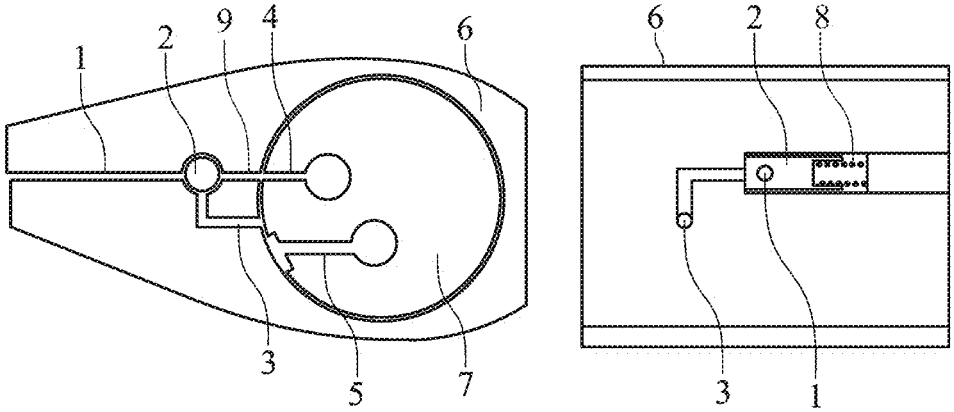
FIG. 1 is a schematic depiction of an example rocker assembly that incorporates an embodiment of a system for synchronizing switching according to this disclosure, with the system shown in two different cross-sectional views.

FIG. 1 illustrates an embodiment of the system for synchronizing switching in accordance with this disclosure, in which the system may be disposed in an example rocker assembly comprising a rocker arm 6 and a rocker shaft 7 that supports the rocker arm 6 in a pivotable manner. In certain applications, for example, the rocker assembly may be used for actuating engine valves in a multi-cylinder engine that is configured with cylinder deactivation functionality, i.e., one or more valves associated with a selected combination of cylinders can be disabled for the purpose of adjusting engine and/or fuel efficiency as needed. In such cases, for the purpose of delivering selective deactivation on demand, a switching mechanism (although not shown) is typically employed, which for example may be coupled to the rocker arm 6 or otherwise incorporated by the rocker assembly.

As an example and not by way of limitation, the switching mechanism may in general be configured for selectively shifting its associated movable components between a latched position that enables main lift event of the valve and an unlatched position that disables valve actuation under the control of a source of force. In practice, during the period when the rocker arm is rotating, i.e., during the lift event, the switching mechanism may be subject to considerable system loading as it transfers actuation motion from the camshaft to the associated engine valves. In this case, such load on the switching mechanism may generate a friction force so high that the switching mechanism is prevented from moving regardless of the control force (if any) applied to the switching mechanism. During the period when the rocker arm is not rotating, e.g., when it is in contact with base circle of the camshaft and receives zero lift, load applied on the switching mechanism is accordingly removed, thus releasing the switching mechanism so as to allow switching thereof between the latched position and the unlatched position. Ideally, it may be desirable to control movement of the switching mechanism such that the switching process may advantageously start as soon as the valve lift is finished in order to maximize time available for the switching.

For a conventional system to achieve such maximization, electronic signal to the control system must be precisely synchronized so as to control switching to occur only when the base circle starts. However, determining the exact timing of when to switch is particularly challenging because it requires a complex matrix that takes into account various operational parameters such as velocity of the engine, oil pressure, oil temperature, and so on. By contrast to the prior art solution, the system for synchronizing switching in accordance with this disclosure can achieve maximization of switching time in a much simpler way. Moreover, the system of this disclosure may guarantee proper switching even if the control system for activating the switching mechanism is not precisely synchronized, thus significantly reducing the complexity of control schemes required for implementing the switching process. This may also help to reduce the possibility of partial latching or engagement of the switching mechanism that may result in critical shift because switching mechanism will have at its disposal sufficient time to fully complete its stroke so as to be positioned into complete engagement.

Example configurations of switching mechanism that may be used in connection with the system for synchronizing switching of this disclosure may include but not limited to deactivating roller, split rocker, switchable lifter, switchable castellation, etc., just to name a few. Though described in the context of such switching mechanisms, those of skill in the art will recognize that the system for synchronizing switching in accordance with this disclosure may be equally applicable and beneficial for use in other suitable configurations of valve actuation system including those using mechanical latching as well as hydraulic latching or the like.

In particular embodiments, the system for synchronization may comprise a first body and a second body that are configured for relative movement to each other so that the first and second body can move from a first relative position to a second relative position and vice versa. As a non-limiting example, as illustrated in FIG. 1, the first body may be formed inside the rocker shaft 7 while the second body may be arranged within the rocker arm body 6 such that the second body may move relative to the first body as the rocker arm body 6 pivots around the rocker shaft 7. While depicted in this manner, positions of the first body and the second body are not so limited. Other suitable movable components in a valvetrain assembly may also be adapted as necessary in order to accommodate the system of this disclosure, as will be recognized by those skilled in the art upon reading the detailed descriptions, appended drawings, and claims disclosed herein.

In the illustrated embodiment of FIG. 1, the first body may comprise a first fluid channel 4 connected to a main fluid circuit, which may be configured for receiving pressurized fluid (e.g., oil) from an engine pump or other suitable pressurized fluid source as familiar to those skilled in the art. The first body may further comprise a second fluid channel 5 which may serve as a control gallery fluidly connecting for example to an oil control valve (OCV). The oil control valve may be employed as a separate oil supply that is independent from the example engine pump and can be turned on and/or off according to need. In the embodiment as shown, the first fluid channel 4 and the second fluid channel 5 may be routed from their respective fluid supply sources, namely, the example engine pump and the example oil control valve, to an interface between the rocker shaft 7 and the rocker arm body 6. In this way, to the extent where the rocker arm body 6 rotates to a proper position around the rocker shaft 7, fluid flowing from either one of the first fluid channel 4 and the second fluid channel 5 may be allowed to be communicated via the interface to the rocker arm body 6, and in particular to the second body of the system for synchronization that is arranged inside the rocker arm body 6.

As shown in FIG. 1, the second body may comprise a spool valve 2 that is contained by a spool valve housing, a spring 8 that is coupled to bottom of the spool valve 2 and configured to bias the spool valve 2, and multiple fluid channels, e.g., a third fluid channel 9, a fourth fluid channel 3, and a fifth fluid channel 1, which may be respectively ported to the spool valve housing thus providing flow access to the spool valve 2. The spool valve 2 may be configured to be selectively translatable within the spool valve housing along an axial direction between an open position and a closed position. For example, the spool valve 2 may be driven to the open position by hydraulic control force provided by the example oil control valve or to the closed position under the biasing force of the spring 8. Of course, other suitable biasing elements may be similarly employed in place of the spring 8 for urging the spool valve 2 back to its default position as familiar to one of skill in the art.

As further illustrated, one end of the third fluid channel 9 may be located at the interface between the rocker arm body 6 and the rocker shaft 7 while the other end thereof may be located on the circumferential side wall of the spool valve housing in vicinity to head portion of the spool valve 2. Moreover, one end of the fourth fluid channel 3 may also be positioned at the interface between the rocker arm body 6 and the rocker shaft 7 whereas the other end thereof may be connected to an axial end of the spool valve housing proximately to the third fluid channel 9. Specifically, the third fluid channel 9 and the fourth fluid channel 3 may be ported at such a position on the interface that when the rocker arm body 6 is on base circle, the first fluid channel 4 may be fluidly connected with the third fluid channel 9, and when the rocker arm body 6 rotates to a certain predetermined angular position (e.g., maximum lift position) with respect to the rocker shaft 7, the second fluid channel 5 may be fluidly connected with the fourth fluid channel 3. Furthermore, the fifth fluid channel 1 may open at the circumferential side wall of the spool valve housing at a location that is generally opposite from the third fluid channel 9 in the radial direction. The fifth fluid channel 1 may be configured to fluidly connect the spool valve housing to the downstream switching mechanism (not shown) associated with the rocker arm body 6 so as to prime the switching mechanism with fluid as needed.

Figure 2:
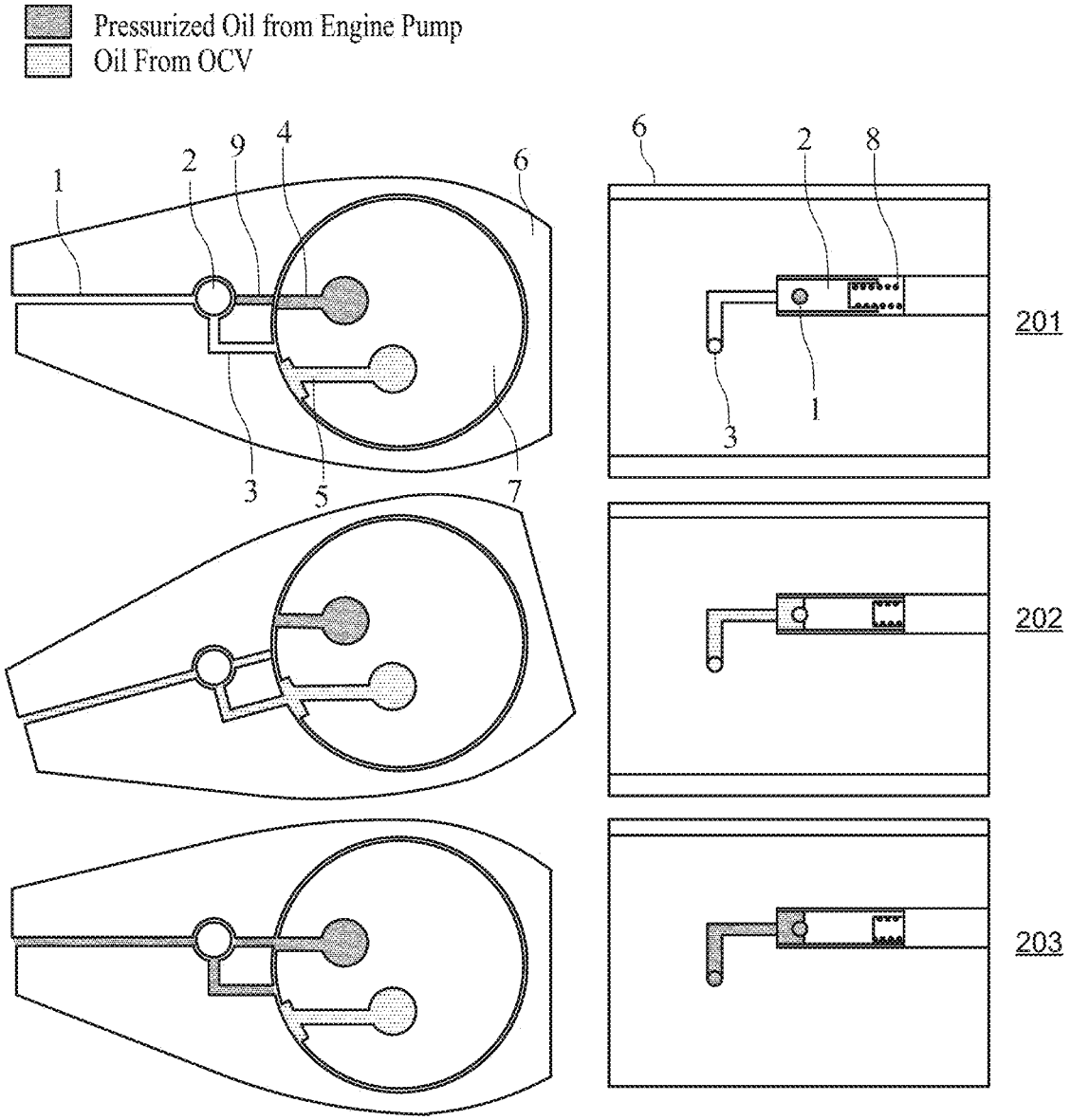
Figure 3:
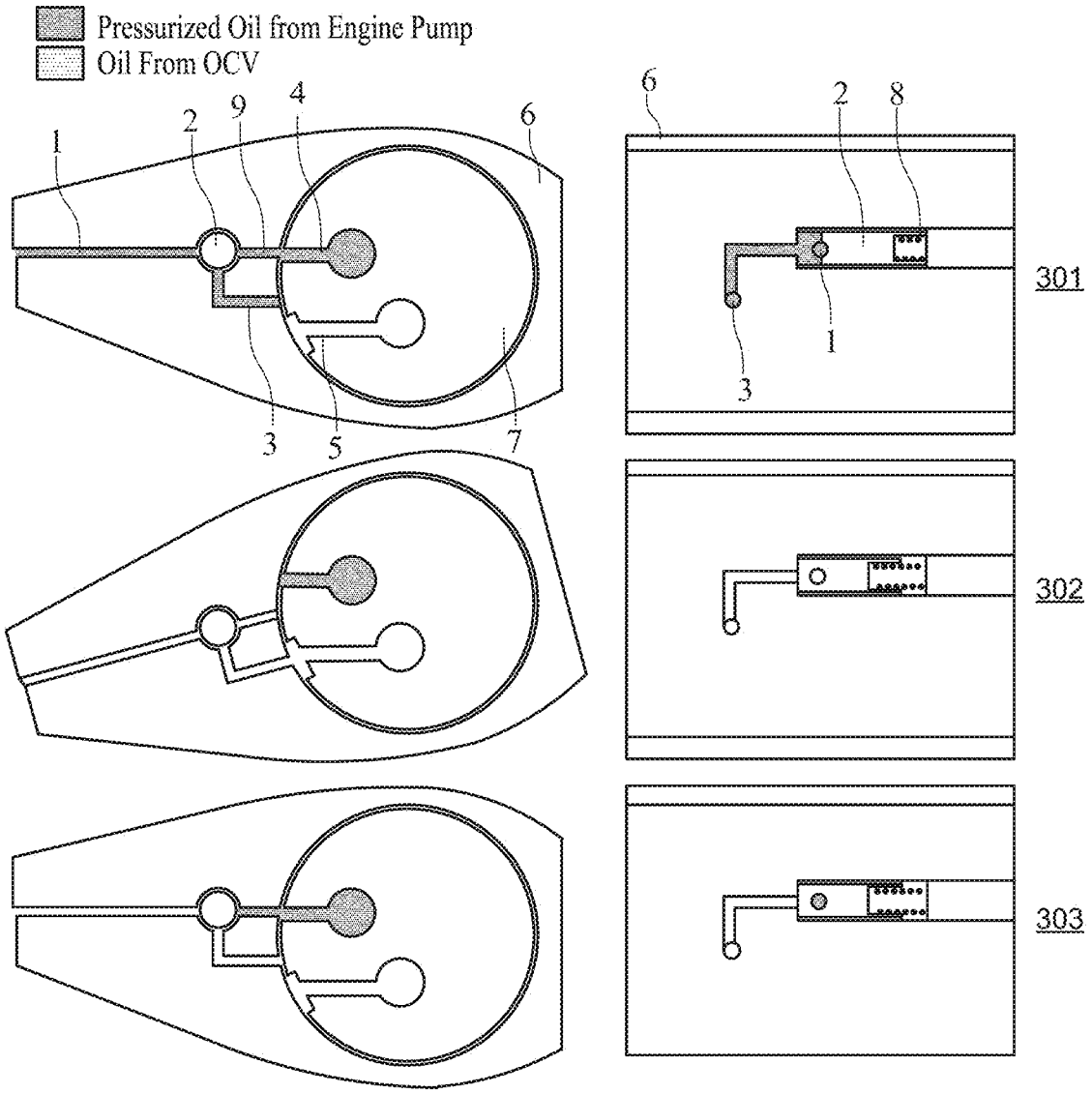
FIG. 3 shows a series of schematic depictions the system for synchronizing switching of FIG. 1 during operation when the oil control valve is turned from on to off.

Referring now to FIGS. 2-3, operation of the system for synchronizing switching is described, in which FIG. 2 particularly shows relative position of the first and second body of the system for synchronizing switching when the example oil control valve is turned from off to on, while FIG. 3 particularly shows relative position of the first and second body of the system for synchronizing switching when the example oil control valve is turned from on to off.

In FIG. 2, at step 201, the rocker arm body 6 is shown on base circle position where the rocker arm body 6 receives no lift from the camshaft and the associated valve is therefore closed. In this operation position, in particular embodiments, the first body and the second body of the system for synchronizing switching are in their first relative position where the first fluid channel 4 is allowed to make fluid connection with the third fluid channel 9 such that the system is in communication with the example engine pump supplying the pressurized fluid. In the meantime, in this first relative position between the first body and the second body, the fourth fluid channel 3 is rotated to such a degree where it is offset from the second fluid channel 5. Consequently, as the example oil control valve is turned on as demanded, though the control fluid from the example oil control valve may fill the second fluid channel 5, it cannot reach the spool valve 2 due to such misalignment of the fourth fluid channel 3 from the second fluid channel 5. Absent of any hydraulic force driving the spool valve 2, the spool valve 2 remains at the default closed position under the biasing spring force (more clearly observed at the right cross-sectional view at 201). Consequently, cross communication among the third fluid channel 9, the fourth fluid channel 3, and the fifth fluid channel 1 is accordingly sealed off by the spool valve 2, thus preventing both the pressurized fluid and the control fluid from reaching the switching mechanism located downstream. In this condition, the switching mechanism stays unlatched.

Then, at step 202, to the extent in which the rocker arm body 6 receives lift from the camshaft and rotates to the predefined angular position as shown (e.g., advantageously around maximum lift)—in this case, the first body and the second body of the system for synchronizing switching are in the second relative position—in particular embodiments, the first fluid channel 9 may be disconnected from the third fluid channel 9 while the second fluid channel 5 may in turn be fluidly connected with the fourth fluid channel 3. As a result, fluid already filling the second fluid channel 5 is permitted to enter the fourth fluid channel 3 and reach the spool valve housing. Accordingly, the resulting hydraulic force may act axially on the spool valve 2, thus pushing the spool valve 2 against the spring 8 to the open position such that entrance to the fifth fluid channel 1 is exposed. In this way, fluid communication to the switching mechanism is enabled and the switching mechanism may be preloaded by the fluid supplied from the example oil control valve. It should be noted that although the switching mechanism is now preloaded, it still remains unlatched at least because the fluid pressure provided by the example oil control valve is insufficient to overcome significant mechanical loading acting on the switching mechanism during the valve lift.

At step 303, the rocker arm body 6 is rotated back on the base circle. Correspondingly, the first body and the second body return to their first relative position where the first fluid channel 4 is re-coupled with the third fluid channel 9 while fluid connection between the second fluid channel 5 and the fourth fluid channel 3 is again interrupted due to their misalignment. In this position, the control fluid from the example oil control valve stops reaching the spool valve 2 anymore, nevertheless the spool valve 2 is kept in the open position by pressurized fluid supplied from the example engine pump in such a way that flow communication via the fifth fluid channel 1 to the switching mechanism is maintained. Because this time the fifth fluid channel 1 has already been preloaded with the control fluid from the example oil control valve, the increase in fluid pressure provided by the example engine pump can be readily transmitted to the switching mechanism. As such, it may be ensured that as soon as the rocker arm body 6 is fully back on base circle, the switching mechanism can be immediately pressurized by the fluid supplied from the example engine pump.

Configured in this manner, the system for synchronizing switching in accordance with this disclosure may advantageously maximize the time available for switching by guaranteeing that actuation of the switching mechanism can be initiated as soon as the valve lift is finished. Also, by controlling synchronization to occur in this substantially mechanical and automatic fashion, the system for synchronization switching of this disclosure can eliminate the need for precise timing of the example oil control that would otherwise be required by a conventional control system for performing switching operation via electronic means, thus reduce complexity of the overall system by a significant degree. Moreover, it may also be helpful in preventing critical shift since the switching mechanism will have maximum time available to be fully engaged into its latched position.

The technical advantages explained above are meant only as an example and not as a limitation. Certain embodiments disclosed herein may provide none, some, or all of the above technical advantages. One or more other technical advantages may be readily apparent to one skilled in the art in view of the figures, descriptions, and claims of this disclosure.

Turning now to FIG. 3, the system for synchronizing switching is described during operation when the example oil control valve is turned from on to off. At step 301, the rocker arm body 6 is in contact with the base circle of the camshaft, and the first body and second body of the system for synchronizing switching are in their first relative position where fluid communication with the example engine pump is enabled and flow passage from the example oil control valve is disconnected. Though the oil control valve is turned off and stops injecting oil to the second fluid channel 5, the spool valve 2 nevertheless maintains its open position under fluid pressure provided by the example engine pump. Accordingly, fluid communication to the switching mechanism via the fifth fluid channel 1 remains enabled, thus keeping the switching mechanism securely latched.

When the rocker arm body 6 rotates to the angular position shown at step 302, fluid connection from the example engine pump is interrupted as the third fluid channel 9 moves out of alignment with the first fluid circuit 4. In this case, hydraulic force pushing the spool valve 2 against the spring 8 is removed, thus the spool valve 2 is urged by the biasing spring force back to its default closed position where access through the fifth fluid channel 1 to the switching mechanism is disabled. However, in this situation, even though no fluid can arrive at the switching mechanism, the switching mechanism still remains in its latched configuration due to mechanical loading of the engine valves and other motion transmission components of the valvetrain assembly applied on the switching mechanism during the lift event.

Finally, at step 303, as soon as the rocker arm body 6 rotates back on the base circle to close off the valves, thereby removing the system loading on the switching mechanism, the switching mechanism will immediately shift back to its original unlatched position.

It should be noted that in the example embodiment as depicted in FIGS. 2 and 3 throughout the operation cycle of the rocker assembly, e.g., whether during rotation of the rocker arm body 6 or when the rocker arm body 6 is on base circle position, pressurized fluid supply from the example engine pump can be continuously kept open, while the example oil control valve on the other hand may be selectively turned on and/or off anytime during base circle based on need. It will be understood that by implementing in this manner, precision in timing of activation of the oil control valve is made less demanding, thereby simplifying the synchronization of the system.

Figure 4:
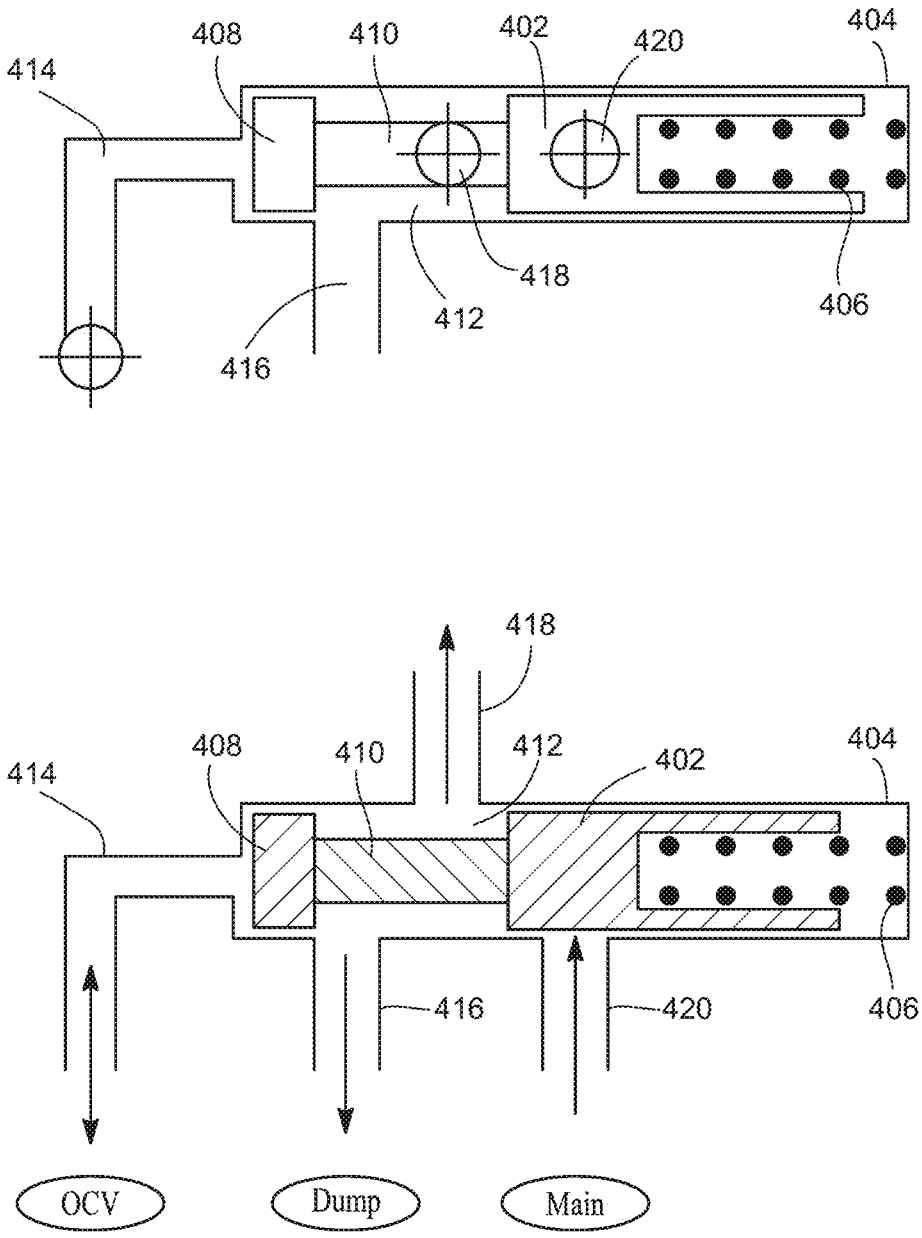
FIG. 4 is a schematic depiction of another embodiment of a system for synchronizing switching according to this disclosure, with the system shown in two different cross-sectional views.

FIG. 4 shows another possible embodiment of a system for synchronizing switching according to this disclosure. As a non-limiting example, similar to the system described with reference to FIGS. 1-3, the system for synchronizing switching may as well comprise a first body and a second body that are configured for relative movement to each other so that the first and second body can move between a first relative position and a second relative position. In some embodiments, the first body may be formed inside the rocker shaft while the second body may be arranged within the rocker arm body such that the second body may move relative to the first body as the rocker arm body pivots around the rocker shaft. Similarly, the first body may be designed with a main fluid circuit connecting to an example engine pump that acts as a pressurized fluid supply and a control circuit coupling with an example oil control valve. During operation of the rocker arm, either the main fluid circuit or the control circuit is allowed to establish fluid communication with the second body disposed inside the rocker arm. Again, while described in this particular manner, the system for synchronizing switching is not so limited. Those skill in the art will appreciated that the system for synchronizing switching of this disclosure may be used in combination with other suitable motion components in a valvetrain as well.

In this embodiment as shown, the system for synchronizing switching is provided with a spool valve 402, which may be housed within a spool valve housing 404 and configured to be movable between an open position and a closed position, e.g., along an axial direction of the spool valve housing 404. As depicted, the spool valve 402 is designed with a valve head 408 that is suitable for receiving hydraulic force to push the spool valve 402 to open, a valve stem 410 connecting the valve head 408 to main body portion of the spool valve 402, and a valve spring 406 provided at bottom of the spool valve 402 which may bias the spool valve 402 into the closed position. Additionally, as illustrated in this embodiment, an annular space 412 may be formed between the valve stem 410 and interior wall of the spool valve housing 404, which may be suitable for providing a passage for fluid to flow therethrough.

As further shown in this example embodiment, the spool valve housing 404 may be connected to four respective fluid channels, i.e., a first fluid channel 414, a second fluid channel 416, a third fluid channel 418, and a fourth fluid channel 420. As depicted, the first fluid channel 414 may be fluidly connected to an axial end of the spool valve housing 404 in proximity to the valve head 408 of the spool valve 402, while the second, third, and fourth fluid channels 416, 418, and 420 may be ported to circumferential side wall of the spool valve housing 404 at a certain distance relative to each other along an axial direction. In particular embodiments, the first fluid channel 414 may serve to receive fluid (e.g., oil) from the control circuit that is in connection with the example oil control valve and release the fluid axially into the spool valve housing 404 so as to push the spool valve 402 to the open position. The second fluid channel 416 (shown as closest to the first fluid channel 414) may be used as a dump passage providing exit for fluid contained within the annular space 412 around the valve stem 410 to be drained. The third fluid channel 418 may be in fluid communication with a switching mechanism (not shown) associated with the rocker arm and is configured to supply control fluid to the switching mechanism when a proper flow pathway through the spool valve housing 404 has been established (details of which will be explained below). And finally, the fourth fluid channel 420 which is shown as located farthest away from the first fluid channel 414 may be configured for receiving pressurized fluid (e.g., oil) from the main fluid circuit in communication with the example engine pump and injecting the pressurized fluid radially into the spool valve housing 404. In particular, such pressurized fluid may serve as fluid to be communicated through the third fluid channel 418 to activate latching of the switching mechanism when the spool valve 402 is opened.

Operation of this embodiment of the system for synchronizing switching will be described in greater details in the following. In the example embodiment of FIG. 4, during operation, when the example oil control valve is turned off, i.e., no fluid is flowing through the first fluid channel 414 to drive the spool valve 402, the spool valve 402 may be kept in its closed state under the spring force provided by the valve spring 406. In this position of the spool valve 402, body portion of the spool valve 402 may be in such an axial location so as to close off the opening to the fourth fluid channel 420 such that no pressurized fluid is allowed to enter the spool valve housing 404. Therefore, pressure communication to the downstream switching mechanism is cut off, resulting the switching mechanism to remain unlatched.

As the example oil control valve is turned on and supplies fluid via the first fluid channel 414 to the spool valve housing 404 (this may preferably happen when the rocker arm is rotating around maximum lift), the supplied fluid may act upon the valve head 408 of the spool valve 402 and push the spool valve 402 (e.g., to the right as shown) against the biasing spring force to the open position. In this configuration, the opening of the fourth fluid channel 420 on the spool valve housing 404 may be exposed by movement of the spool valve 402, thus allowing pressurized fluid coming from the example engine pump to enter the annular space 412 between the valve stem 410 and interior wall of the spool valve housing 404. The pressurized fluid may then flow pass the annular space 412 into the third flow channel 418 and finally reach the switching mechanism so as to pressurize the switching mechanism to move. It should be noted that in this open position of the spool valve 402, flow connection between the annular space surrounding the valve stem with the second fluid channel 416 (i.e., dump path) may be substantially closed off by the valve head 408 such that fluid pressure communicating from the fourth fluid channel 420 through the third fluid channel 418 to the switching mechanism is effectively maintained at a desired level so as to keep the switching mechanism securely latched in place.

Thereafter, when unlatching of the switching mechanism is needed, the oil control valve may be turned off and the spool valve 402 once again returns to its default closed state (the position as depicted in FIG. 4) under the biasing force of the valve spring 406. Accordingly, pressurized fluid supply from the engine pump via the fourth fluid channel 420 is interrupted or blocked by returning of the spool valve 402. At the same time, stroke of the spool valve 402 may be further designed to enable communication of the annular space 412 surrounding the valve stem 410 with the second fluid channel 416 such that fluid pressure previously priming the switching mechanism may be released as the fluid exits from the second fluid channel 416 out of the spool valve housing 404. Consequently, due to this decrease in fluid pressure, the switching mechanism is allowed to shift back to its unlatched state.

Configured in the manner as described above with reference to FIG. 4, the embodiment of the system for synchronizing switching may use the example oil control valve only to control movement of the spool valve 402 so as to either open or close the passage from the fourth fluid channel 420 to the third fluid channel 418 (and correspondingly to the switching mechanism). In other words, in this embodiment, no control fluid from the example oil control valve can access the switching mechanism. Additionally, it may be desirable that the opening of the spool valve 402 occurs when the rocker arm is rotating around its maximum lift position.

Figure 5:
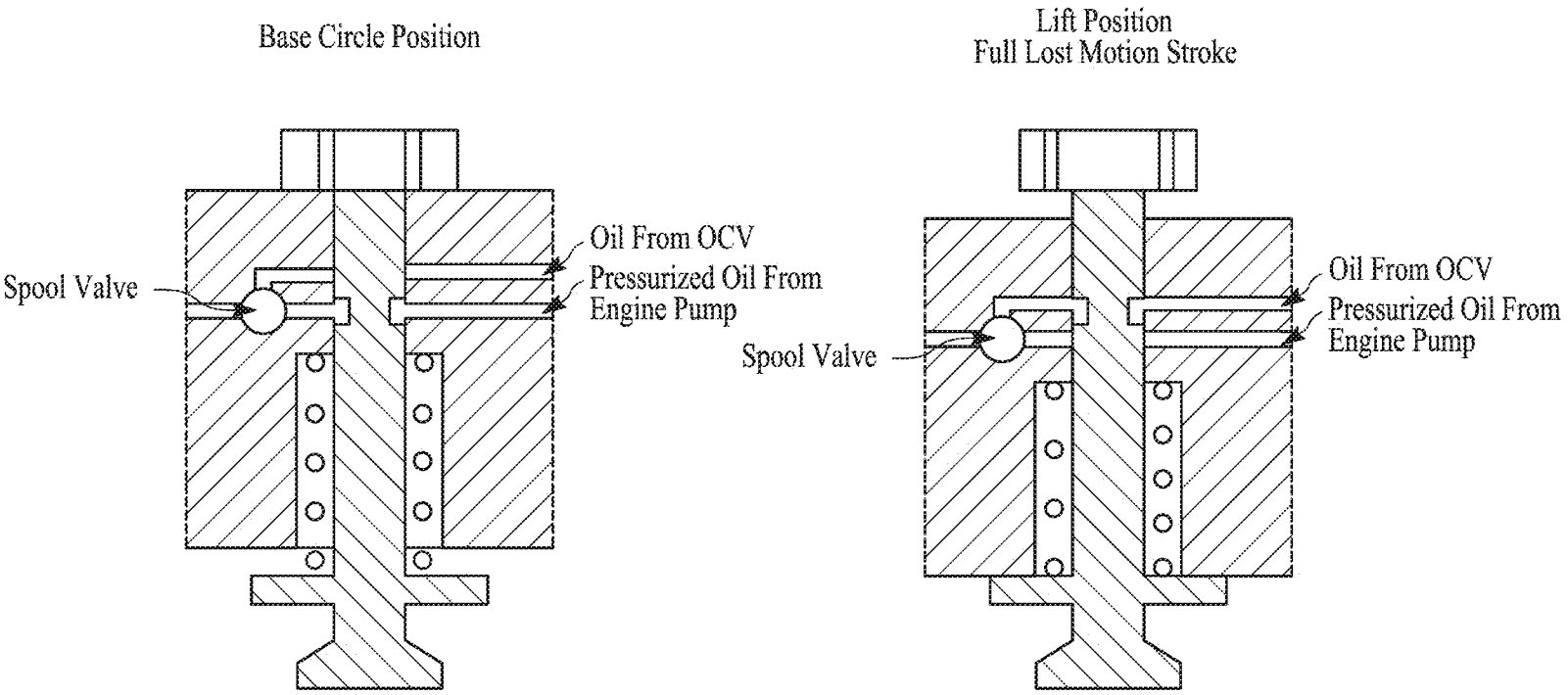
FIG. 5 is a schematic depiction of a further embodiment of a system for synchronizing switching according to this disclosure used in combination with a lost motion shaft.

FIG. 5 schematically illustrates a further possible embodiment of a system for synchronizing switching in accordance with this disclosure that is used in connection with a lost motion shaft, in which the depiction on the left is shown when a rocker arm associated with the lost motion shaft is at base circle position, while the depiction on the right is shown when the rocker arm is at lift position.

In this embodiment of FIG. 5, the system for synchronizing switching is configured substantially in a similar manner as those described above in that it comprises a spool valve, a first fluid channel configured for receiving fluid from an example oil control valve, a second fluid channel configured for receiving pressurized fluid from an example engine pump, and a third fluid channel fluidly couple to a switching mechanism (not shown). However, in this embodiment, selective fluid communication of the system with either the example oil control valve or the example engine pump is controlled via stroke of the lost motion shaft. To implement this configuration, for example, a groove formed on sidewall surface of the lost motion shaft may be used for receiving fluid coming from either the example oil control valve or the engine pump. For example, when the lost motion shaft is extended, i.e., this may happen when the rocker arm is on base circle, the groove is moved into engagement with second fluid channel such that pressurized fluid supplied by the example engine pump may flow through the annular gap into the second fluid channel and serve a similar function as described above with reference to FIG. 2 (e.g., in particular at step 201 or 203). On the other hand, when the lost motion shaft is retracted to complete it full stroke, the groove may shift for example vertically upwards in the depiction as shown to connect with the first fluid channel that receives control fluid from the example oil control valve. When this happens, the control fluid may push the spool valve to an open position and optionally further fill the third fluid channel so as to preload the switching mechanism located downstream. Other suitable modifications and variations may also be employed for the purpose of performing the desired function of this disclosure and will not be described in exhaustive details so as to avoid obscuring the scope of this disclosure.

Herein, "or" is inclusive and not exclusive, unless expressly indicated otherwise or indicated otherwise by context. Therefore, herein, "A or B" means "A, B, or both," unless expressly indicated otherwise or indicated otherwise by context. Moreover, "and" is both joint and several, unless expressly indicated otherwise or indicated otherwise by context. Therefore, herein, "A and B" means "A and B, jointly or severally," unless expressly indicated otherwise or indicated otherwise by context.

The scope of this disclosure encompasses all changes, substitutions, variations, alterations, and modifications to the example embodiments described or illustrated herein that a person having ordinary skill in the art would comprehend. The scope of this disclosure is not limited to the example embodiments described or illustrated herein. Moreover, although this disclosure describes and illustrates respective embodiments herein as including particular components, elements, feature, functions, operations, or steps, any of these embodiments may include any combination or permutation of any of the components, elements, features, functions, operations, or steps described or illustrated anywhere herein that a person having ordinary skill in the art would comprehend. Furthermore, reference in the appended claims to an apparatus or system or a component of an apparatus or system being adapted to, arranged to, capable of, configured to, enabled to, operable to, or operative to perform a particular function encompasses that apparatus, system, component, whether or not it or that particular function is activated, turned on, or unlocked, as long as that apparatus, system, or component is so adapted, arranged, capable, configured, enabled, operable, or operative. Additionally, although this disclosure describes or illustrates particular embodiments as providing particular advantages, particular embodiments may provide none, some, or all of these advantages.

What is claimed is:

1. A system for synchronizing switching, the system comprising:

a first body coupled to a pressurized fluid supply and a control fluid supply; and a second body including:

a spool valve configured to slide within a spool valve housing so as to switch between an open position and a closed position, a biasing element configured to bias the spool valve, and a plurality of fluid channels configured to be fluidly connected to the spool valve housing, the plurality of fluid channels including a first fluid channel, a second fluid channel, and a third fluid channel;

wherein the first body and the second body are configured to move relative to each other between a first relative position and a second relative position, the first fluid channel being in fluid communication with the pressurized fluid supply when the first body and the second body are in the first relative position, and the second fluid channel being in fluid communication with the control fluid supply when the first body and the second body are in the second relative position;

wherein the spool valve is further configured to selectively control fluid communication between the third fluid channel and either the first fluid channel or the second fluid channel based on the relative movement between the first body and the second body; and wherein fluid flowing from the control fluid supply via the second fluid channel flows through the spool valve housing into the third fluid channel when the spool valve is in the open position.

2. The system of claim 1, wherein the pressurized fluid supply is an engine pump.

3. The system of claim 1, wherein the control fluid supply is an oil control valve configured to selectively supply control fluid.

4. The system of claim 1, wherein the third fluid channel is configured to be fluidly coupled to a switching mechanism.

5. The system of claim 1, wherein fluid flowing from the control fluid supply via the second fluid channel into the spool valve housing drives the spool valve into the open position.

6. The system of claim 1, wherein fluid flowing from the pressurized fluid supply via the first fluid channel flows through the spool valve housing into the third fluid channel when the spool valve is in the open position.

7. The system of claim 1, wherein when the spool valve is in the open position, fluid flowing from the pressurized fluid supply via the first fluid channel flows into the spool valve housing so as to maintain the spool valve in the open position.

8. The system of claim 1, wherein the biasing element is configured to bias the spool valve towards the closed position.

9. The system of claim 1, wherein the fluid communication through the spool valve housing to the third fluid channel is disabled when the spool valve is in the closed position.

10. The system of claim 1, wherein the plurality of fluid channels further includes a fourth fluid channel configured to drain fluid contained within the spool valve housing when the spool valve is in the closed position.

11. The system of claim 10, wherein the fluid communication from the spool valve housing to the fourth fluid channel is prevented when the spool valve is in the open position.

12. The system of claim 1, wherein the biasing element is a spring.

13. The system of claim 1, wherein the relative movement between the first body and the second body is caused by a rotation of a rocker arm.

14. The system of claim 13, wherein the fluid communication between the first fluid channel and the pressurized fluid supply is enabled when the rocker arm is at a base circle position, and the fluid communication between the second fluid channel and the control fluid supply is enabled when the rocker arm is at a maximum lift position.

15. The system of claim 14, wherein when the spool valve is in the open position, fluid flowing from the pressurized fluid supply via the first fluid channel is enabled to flow through the spool valve housing into the third fluid channel when the rocker arm is at the base circle position.

16. A system for synchronizing switching, the system comprising:

a spool valve configured to slide within a spool valve housing so as to switch between an open position and a closed position;

a biasing element which biases the spool valve towards the closed position; and a plurality of fluid channels fluidly connected to the spool valve housing, the plurality of fluid channels including a first fluid channel, a second fluid channel, a third fluid channel, and a fourth fluid channel;

wherein the first fluid channel is configured to receive fluid from a control fluid supply, the second fluid channel is configured to receive fluid from a pressurized fluid supply, the third fluid channel is connected to a switching mechanism of a rocker arm, and the fourth fluid channel is located between the first fluid channel and the second fluid channel so as to drain fluid contained within the spool valve housing when the spool valve is in the closed position;

wherein the spool valve is switched to the open position via fluid from the first fluid channel; and wherein in the open position, the spool valve opens fluid communication from the second fluid channel to the third fluid channel so as to actuate the switching mechanism.

17. A system for synchronizing switching, the system comprising:

a lost motion shaft fluidly coupled to a pressurized fluid supply and a control fluid supply;

a spool valve configured to slide within a spool valve housing so as to switch between an open position and a closed position;

a biasing element which biases the spool valve towards the closed position; and a plurality of fluid channels fluidly connected to the spool valve housing, the plurality of fluid channels including a first fluid channel, a second fluid channel, and a third fluid channel;

wherein the lost motion shaft is configured to move between (i) a lifted position which opens fluid communication from the control fluid supply to the first fluid channel, and (ii) a base position which opens fluid communication from the pressurized fluid supply to the second fluid channel; and wherein the spool valve is selectively switched between the open position and the closed position so as to control fluid communication between the third fluid channel and either the first fluid channel or the second fluid channel.

* * * * *